United States Patent [19]

Plaga

[11] 4,352,602

[45] Oct. 5, 1982

[54] ROOF SUPPORT FOR A MINE GALLERY WHICH EXTENDS AT A RELATIVELY LARGE ANGLE INCLINED TO THE HORIZONTAL

[75] Inventor: Kurt Plaga, Herne, Fed. Rep. of Germany

[73] Assignee: Bochumer Eisenhuette Heintzmann GmbH & Co., Bochum, Fed. Rep. of Germany

[21] Appl. No.: 223,295

[22] Filed: Jan. 8, 1981

[30] Foreign Application Priority Data

Jan. 21, 1980 [DE] Fed. Rep. of Germany ..... 3001994

[51] Int. Cl.[3] ..... E15D 23/04

[52] U.S. Cl. ..... 405/291; 405/295; 405/296

[58] Field of Search ..... 405/291-301; 299/31, 33

[56] References Cited

U.S. PATENT DOCUMENTS

| | | | |
|---|---|---|---|
| 3,431,738 | 3/1969 | Groetschel | 405/299 |
| 4,065,930 | 1/1978 | Spies | 405/296 |
| 4,169,689 | 10/1979 | Weirich et al. | 405/291 |
| 4,195,953 | 4/1980 | Becker et al. | 405/300 |
| 4,227,833 | 10/1980 | Plester et al. | 405/291 X |

FOREIGN PATENT DOCUMENTS

| | | | |
|---|---|---|---|
| 1028515 | 4/1958 | Fed. Rep. of Germany | 405/291 |
| 1052336 | 3/1959 | Fed. Rep. of Germany | 405/291 |
| 2506779 | 8/1976 | Fed. Rep. of Germany | 405/291 |

*Primary Examiner*—Dennis L. Taylor
*Attorney, Agent, or Firm*—Michael J. Striker

[57] ABSTRACT

A roof support for a mine gallery which extends at a relatively large angle to the horizontal comprises an upper, a middle and a lower roof support unit arranged adjacent each other and having each a pair of elongated transversely spaced skids rigidly connected by bridges to each other and engaging the sole of the inclined mine gallery. An abutment beam likewise engaging the sole is arranged inclined to the elongation of the skids adjacent to the face of the gallery to be mined and connected to the skids of the middle roof support unit by a pair of flat sole plates rigid with the beam and tiltable about horizontal axes with respect to the skids, whereas the upper and the lower roof support unit are connected to the beam by flat elongated sole engaging end members connected to the beam pivotable about vertical pivot axes. In this way ample space is provided beneath the roof of the mine gallery between the beam and the roof support units to permit mining of coal seams of small height. The upper and the lower roof support units include elongated guide members in which advancing cylinder and piston units are located, and a pair of directing cylinder and piston units connect the elongated end members of the upper and lower roof supporting units with the adjacent sole plates of the middle unit.

10 Claims, 4 Drawing Figures

ROOF SUPPORT FOR A MINE GALLERY WHICH EXTENDS AT A RELATIVELY LARGE ANGLE INCLINED TO THE HORIZONTAL

BACKGROUND OF THE INVENTION

The present invention relates to a roof support for a mine gallery which extends at a relatively large angle inclined to the horizontal and comprising three adjacent mine roof support units, of which the upper and the lower roof support units are connected by guiding devices with integrated advancing cylinders located between the sole engaging skids thereof to an elongated abutment beam for pivoting movement about vertical pivot axes, whereas the middle roof supporting unit is connected to the beam tiltable about a pivot axis extending transverse to the elongation of the skids, and in which at least the middle and the lower roof supporting units are connected to each other by a directing cylinder and piston unit.

Such a mine roof support is for instance disclosed in the German Auslegeschrift No. 23 37 218. In this known construction each of the three roof support units comprises a pair of transversely spaced sole engaging skids which are relatively movably connected to each other by bridging members arranged in the region of the skids directed toward the face of the mine gallery to be mined, in which the bridging members are connected to the skids tiltable about tilting axes extending parallel to the skids. Advancing cylinder and piston units are arranged between the skids and the rear ends of these cylinder and piston units are linked to guiding devices arranged between the skids.

The guiding devices of the upper and the lower roof support units are provided at the end thereof directed towards the mine face with linking heads by means of which they are linked to the abutment beam which is arranged above the end sections of the skids which are directed toward the mine face. The pivot axes between the guide means and the abutment beam extend normal to the longitudinal direction of the beam.

The middle roof support unit is directly linked to the abutment beam by means of rods arranged laterally of the skids thereof and the opposite ends of these rods are respectively connected to the beam and the respective skid tiltable about tilting axes extending parallel to the longitudinal direction of the beam. The guide means of the middle roof supporting unit is not linked to the abutment beam, but its free end is provided with a push rod which is pressed against a conveyor.

In addition, a directing cylinder and piston unit is connected at opposite ends to adjacent skids of the middle and the lower roof supporting unit.

One disadvantage of this known construction in which the abutment beam is arranged above the ends of the skids is that the space between the beam and the roof shield of the mine roof supporting units through which a miner may pass is considerably reduced so that this known construction may not be used for mining of coal seams of small height.

A further disadvantage of this known construction is the arrangement of the directing cylinder between adjacent skids of the middle and lower mine roof support units. This arrangement results in that the control of the directing cylinder has to consider the relative movements between the lower and the middle roof support unit during the advance thereof as well as those movements which are produced during the unavoidable deflection of the units during their movement. This means a complicated construction of such a control arrangement. In order for such a control arrangement to work properly, it is adjusted in such a manner that the directing cylinder during advancing movement of one of the two roof supporting units will be made pressureless. That means, that during the advancing movement no directing of the respective unit can be provided. Such directing must be performed while the roof shield and the skids are respectively pressed against the roof and the sole of the mine gallery. This means to overcome exceedingly high friction and therefore the directing cylinder and piston unit has to be constructed of such size so as to overcome this friction.

No directing cylinder and piston units are provided in the construction of the prior art between the skids of the middle and the upper roof support unit. In this known construction the normal position of the upper roof support unit with respect to the abutment beam is to be accomplished only by a slip-in device arranged beneath the abutment beam. In this case it is however to be expected that, due to the given lever ratios, the draw-in of the free ends of the skids between the members of the slip-in device will require a considerable force and therefore a large enough advancing piston and cylinder unit of the guide means.

SUMMARY OF THE INVENTION

It is an object of the present invention to provide a mine roof support of the aforementioned kind which avoids the disadvantages of the construction according to the prior art.

It is an a further object of the present invention to provide a mine roof support usable also during mining of coal seams of relatively small height.

It is an additional object of the present invention to provide a mine roof support in which the upper as well as the lower mine roof support unit may be properly steered without the necessity of overcoming large friction resistance.

With these and other objects in view, which will become apparent as the description proceeds, the roof support for a mine gallery which extends at a relatively large angle inclined to the horizontal mainly comprises an upper roof support unit, a middle roof support unit and a lower roof support unit arranged adjacent to each other and each having a pair of transversely spaced skids engaging the sole of the inclined mine gallery, an abutment beam extending inclined to the elongation of the skids and adapted to be located adjacent a face of the gallery to be mined, a pair of flat sole plates, each fixedly connected at one end edge thereof to the abutment beam and on the opposite end edge thereof to a respective one of the skids of said middle roof support unit tiltable about an axis extending transverse to the elongation of the skids. The upper and the lower roof support units include each elongated guide means with an advancing cylinder and piston unit provided therein and a flat end member connected at one end to the abutment beam for pivoting about a substantially vertical pivot axis, and a pair of directing cylinder and piston units, one of which is pivotally connected at opposite ends respectively to the flat end member of the guide means of the upper support unit and the flat sole plate of the middle support unit adjacent thereto and the other pivotally connected at opposite ends respectively to the flat end member of the guide means of the lower roof support unit and the flat sole plate of the middle roof support unit adjacent thereto.

An essential characteristic of the present invention is thus derived space between the abutment beam and the three roof support units which permits a miner even during mining of seams of small height, for instance of only 500 mm to pass without danger between the support beam and the skids of the roof support units. This is obtained, on the one hand, due to the sole plates which closely abut against the sole of the mine gallery between the abutment beam and the middle roof support unit, and on the other hand, due to the flat end members likewise abutting against the sole of the mine gallery and arranged between the abutment beam and the upper and lower roof support units.

A further essential characteristic of the present invention is the connection of the guide means of the upper and lower roof support unit by means of the directing cylinder and piston units to the sole plates of the middle unit which form a rigid part of the abutment beam. This provides the advantage that the skids may be moved freely along the guide means by the advancing cylinder and piston units integrated therein irrespective of the relative position of the guide means with respect to the abutment beam. The position of the upper and the lower roof support unit can therefore during the advance thereof be corrected according to given requirements. This makes large dimensioned directing cylinder and piston units unnecessary since no increased friction resistances have to be overcome.

The middle roof support unit forms due to its linkage to the sole plates over axes extending transverse to the longitudinal direction of its skids a substantially rigid part of the abutment at least as far as a movement in or counter the direction of the inclination of the sole of the mine gallery is concerned. The middle roof support unit constitutes therefore in its braced condition tightly engaging the roof and the sole of the mine gallery a positive abutment during advance of the upper and the lower roof support units.

In this connection it is advantageous that the sole engaging skids of the middle roof support unit are linked at its front edges thereof directed toward the mine face to the sole plate. Thereby it is possible to obtain by combed-like toothing a very stiff linkage connection in a direction transverse to the skids thereof, respectively in the longitudinal direction of the abutment beam without impairing the necessary articulation in the direction normal to the sole of the mine gallery.

The arrangement of the sole plate between the abutment beam and the middle roof support unit permits in addition to set the roof support units in an optimal manner with regard to the geological conditions, since now the abutment beam may be arranged at an angle different from 90° with respect to the advancing direction of the roof support unit, whereas in the construction of the prior art the abutment beam must be arranged substantially normal to the advancing direction of the roof support units.

The directing cylinder and piston units between the sole plates of the middle roof support unit and the flat end members of the upper and lower roof support units may be arranged normal to the direction of advancement of the roof support unit or also parallel to the longitudinal direction of the abutment beam. Thereby it is advantageous that the cylinders of the directing cylinder and piston units are linked to the sole engaging plates and the pistons thereof to the flat end members.

In order to assure a precise advancement of the roof support units in the desired direction, the elongated portions of the guide means which are connected to the flat end members on the side thereof facing away from the support beam are constructed as elongated box-shaped housing, respectively surrounding an advancing cylinder and piston unit which at one end directed toward the mine face is linked by a bolt to the housing and on the opposite end is linked by a bolt to the skids, whereby the latter bolt is guided in elongated slots in the housing. In this way, a stabile guiding of the roof support units is assured and at the same time the advancing cylinder and piston units are properly protected.

The sole engaging skids of each roof supporting units are rigidly connected to each other. Such a connection may be carried out in various different ways. In a preferred construction according to the present invention, the sole engaging skids of each roof supporting unit are rigidly connected to each other by bridges of U-shaped cross-section extending over the respective guide housing. These bridges extend in longitudinal direction along a major portion of the length of the sole engaging skids and assure thereby not only a bending and torsion resistant unit of the skids but also a proper embedding of the guide housing. For this purpose it is also possible to connect the bottom faces of the skids of each unit by a sheet metal member to each other.

The bending and torsion resistant abutment beam may be formed integral over its whole length. However, in order to adapt the beam to the undergound conditions, and especially to facilitate the transport thereof, the beam is according to the present invention preferably divided into two longitudinal sections linked to each other and in which each section of the beam is by means of the sole plate coordinated therewith connected with the skids of the middle roof supporting units. Since the skids of the middle roof supporting unit are rigidly connected by the aforementioned bridge, the two longitudinal sections of the abutment beam and therewith the two sole plates are mutually stiffened. To reduce the weight of the sole plate, the latter may be provided with various cutouts.

In accordance with the present invention the flat end members of the upper and lower roof support units engage with upwardly offset end portions thereof into pockets formed at the sides of the support beam which is directed away from the mine face. These pockets may for instance be formed by welding elongated U-shaped bent sheet metal members to the base plate of the beam. The connection of the free ends of the flat end members in the pockets of the abutment beam is provided through vertically extending pivot bolts.

A further characteristic of the present invention consists in that the abutment beam is provided on the side thereof directed toward the mine face with a substantially vertically extending guide wall, which on the side facing away from the mine face is stiffened by stiffening ribs. Such a guide wall may replace a conveyor if the inclination of the sole of the mine gallery is large enough in order to permit a downward gliding of the mined coal by gravity.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
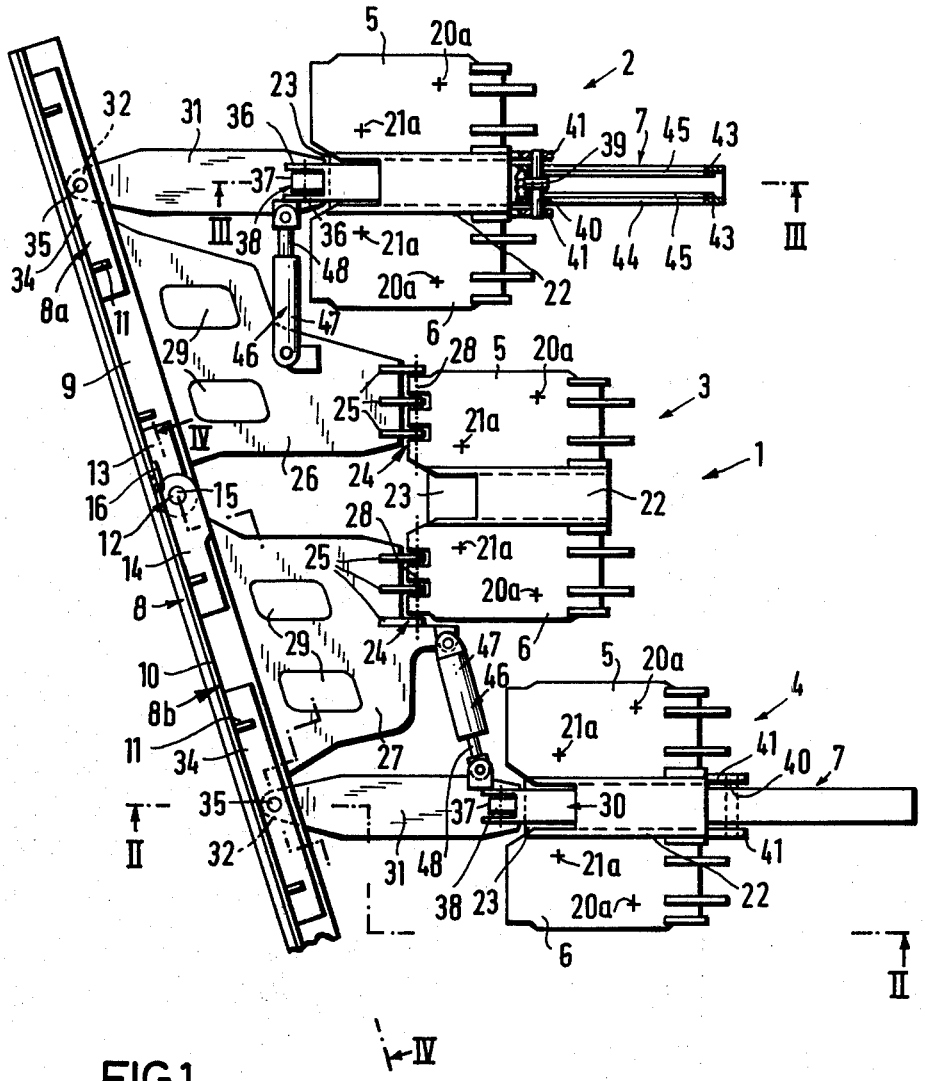
FIG. 1 is a top view of the mine roof support according to the present invention comprising three roof support units and an abutment beam linked thereto in which the roof and rear shields of each roof supporting unit are omitted.

The roof support 1 shown in FIG. 1 for a mine gallery which extends at a relatively large angle inclined to the horizontal comprises three roof support units 2, 3, and 4 which are arranged adjacent to each other. Considering the inclination of the mine gallery in which the three roof supporting units are arranged, the roof supporting unit 2 constitutes the upper roof support unit and the roof support unit 4, the lower roof support unit. Each of the roof support units comprises two transversely spaced sole engaging skids 5 and 6 and the roof supporting units 2 and 4 are linked to an abutment beam 8 extending inclined at angle different from 90° in correspondence of a non-illustrated face of the mine gallery to be mined by guiding devices 7 respectively arranged between the skids 5 and 6 of the units 2 and 4. The middle roof support unit 3 is, however, in the direction of the inclination of the sole of the mine gallert rigidly connected with the abutment beam 8.

Figure 2:
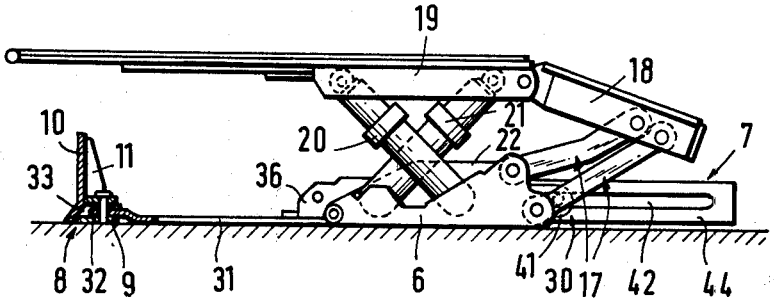
FIG. 2 is a partly sectioned side view of a roof support unit including the abutment beam linked thereto in which the section is taken along the line II—II of FIG. 1.
Figure 3:
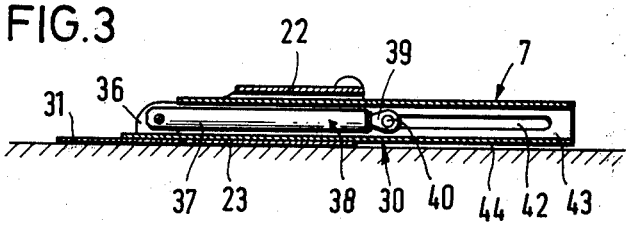
FIG. 3 is a vertical cross-section taken along the line III—III of FIG. 1 through a roof support unit in the region of its central guiding device.
Figure 4:
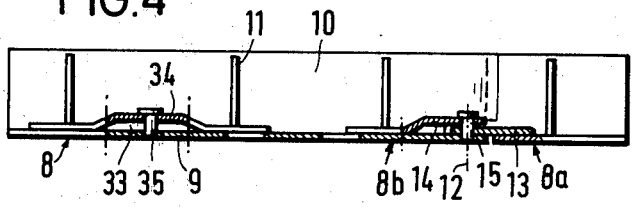
FIG. 4 is a vertical section taken along the line IV—IV of FIG. 1 through the abutment beam and a sole plate coordinated therewith.

As can be visualized from FIGS. 1, 2 and 4, the abutment beam 8 has a base portion formed by a sheet metal member 9 engaging the sole of the mine gallery, to an edge thereof directed toward the mine face a substantially L-shaped guide wall 10 likewise formed of a sheet metal member is welded. A plurality of stiffening ribs 11 are provided on the side of the guide wall 10 which is directed away from the mine face. The abutment beam 8 preferably comprises two longitudinal sections **8*a* and 8*b* which are linked to each other. The linking axis 12 extend normal to the base 9 of the beam. To connect the two longitudinal sections 8*a* and 8*b* to each other a sheet metal 13 is welded to the upper section 8*a* of the beam which passes over the lower section 8*b*. An S-shaped, towards the roof of the mine gallery offset sheet metal member 14 is welded to the beam section 8*b* which overlaps the sheet member 13 of the beam section 8*a*. A vertically extending pivot bolt 15 passes through openings formed in the offset sheet metal member 14 and openings in the sheet metal member 13 and the base plate of the section 8*b*. The likewise divided guide wall 10 is in the linkage region provided with a nose-like overlapping 16**.

Each of the roof supporting units 2–4 comprises as shown in FIGS. 1 and 2 two rigidly connected sole engaging skids 5 and 6, a rear shield 18 connected to the skids 5 and 6 by a linkage 17, a roof engaging shield 19 linked to the rear shield as well as fluid operated expandable and retractable props 20 and 21 respectively linked at opposite ends to the roof engaging shield 19 and the respective skids, whereby between each skid 5 and 6 and the roof shield 19 two cross-like arranged props 20 and 21 are provided. The bearing portions of the props 20 and 21 at the skids 5 and 6 are designated in FIG. 1 respectively with the reference numbers **20*a* and 21*a***.

The skids 5 and 6 of each of the roof support units 2–4 are rigidly connected to each other by bridges 22 of U-shaped cross-section which extend about three-quarters of the length of the skids. The skids 5 and 6 of each unit are further connected to each other by a bottom sheet metal member 23.

The front edges of the skids 5 and 6 of the mine roof supporting unit 3 is provided with serrations 24 into which bearing webs 25 of sole plates 26 and 27 are engaged, which sole plates are respectively rigidly connected with the two longitudinal sections **8*a* and 8*b* of the abutment beam 8. Link bolts 28 passing through alinged bores formed in the serrations 24 and the webs 25 and extending transverse to the skids 5 and 6 tiltably connect the skids 5 and 6 of the middle roof support unit 3 with the sole plates 26 and 27 which closely abut against the sole of the mine gallery and which are provided with cutouts 29**.

The middle roof support unit 3 is therewith in the plane of the sole plates 26 and 27 non-articulatedly, and in a direction normal to the plane articulatedly connected with the abutment beam 8.

The guide means 7 which are arranged between the skids 5 and 6 of the upper roof support unit 2 and those of the lower roof support unit 4 are composed of a housing forming longitudinal section 30 and a flat end member 31 extending therefrom toward the abutment beam 8. The flat end members 31 closely engage in the region between the front edges of the skids 5 and 6 and the abutment beam 8 the sole of the mine gallery and engage with S-formed upwardly offset tilting tongues 32 into pockets 33 which are provided at the side of the beam 8 facing away from the non-illustrated face of the mine fallery which is to be mined. These pockets 33 are formed by the base sheet metal member 9 of the two sections **8*a*, 8*b* of the beam 8 and by upwardly curved U-shaped sheet metal members 34 welded thereto. Vertically extending tilting bolts 35 serve to connect the tongues 32 with the beam 8**.

The housing-like longitudinal section 30 of each guide means 7 has about a length equal to twice the length of the skids 5 and 6. The guide housing 30 is at an end portion thereof facing the beam 8 open toward the roof of the mine gallery so that two lateral bearing webs 36 are formed. These bearing webs 36 serve to anchor the cylinders 37 of a hydraulically operated advancing cylinder and piston unit 38 which is integrated into the guide housing 30. The piston rod 39 of the advancing cylinder and piston unit 38 is linked to a bolt 40 which with opposite ends thereof is engaged respectively in bearing webs 41 which project rearwardly from the skids 5 and 6 closely adjacent to the guide housing 30. The bolts 40 pass with opposite ends through longitudinal slots 42 provided in the side walls 43 of the guide housing 30 and are therefore movable in the longitudinal direction of the slots. For the better support of the bolts 40 and for stiffening the rear sections 44 of the guide housing 30, stiffening ribs 45 are connected to the inner side of the sections 44.

Adjacent to the front edges facing the beam 8, the skids 5 and 6 of the upper roof supporting unit 2 and the lower roof supporting unit 4 are hydraulically operated directing cylinder and piston units 46 provided. The cylinders 47 of the cylinder and piston units 46 are connected to the sole plates 26 by means of appropriate brackets. The piston rods 48 of the directing cylinder and piston units 46 are connected to brackets which are fixed to the flat end members 31.

The roof support of the present invention may be operated as follows:

The props 20 and 21 of the units 2 and 4 are collapsed, while those of the middle unit 2 are extended and then the skids 5, 6 of the units 2 and 4 are advanced toward the mine face, whereby the fixed unit 3 and beam 8 form a proper anchoring for the advancing units. Subsequently thereto, the props of the advanced units are extended, the props of the unit 3 are collapsed and the beam 8 and the unit 3 fixed thereto are then advanced by operating the cylinder and piston units 31 of the units 2 and 4.

Of course it is also possible to advance the units 2 and 4 one after the other instead of advancing the same simultaneously.

It will be understood that each of the elements described above, or two or more together, may also find a useful application in other types of mine roof supports for a mine gallery which extends at a relatively large ange inclined to the horizontal, differing from the types described above.

While the invention has been illustrated and described as embodied in a mine roof support for a mine gallery which extends at a relatively large angle inclined to the horizontal and including three mine roof support unit arranged adjacent to each other and connected to an abutment beam, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A roof support for a mine gallery which extends at a relatively large angle inclined to the horizontal comprising an upper roof support unit, a middle roof support unit and a lower roof support unit arranged adjacent to each other and each having a pair of elongated sole engaging skids; an abutment beam extending inclined to the elongation of the skids and adapted to be located adjacent a face of the gallery to be mined; a pair of flat sole plates, each fixedly connected at one end edge thereof to the abutment beam and on the opposite end edge thereof to a respective one of the skids of said middle support unit tiltable about axes extending transverse to the elongation of said skids; said upper and said lower roof support unit including each elongated guide means with an advancing cylinder and piston unit provided therein and a flat end member connected at one end to said abutment beam for pivoting about a substantially vertical pivot axis; and a pair of directing cylinder and piston units, one of which being pivotally connected at opposite ends respectively to said flat end member of the guide means of said upper roof support unit and the flat sole plate of the middle roof support unit adjacent thereto and the other being pivotally connected at opposite ends respectively to the flat end member of the guide means of said lower roof support unit and the flat sole plate of said middle roof support unit adjacent thereto.

2. A mine roof support as defined in claim 1, wherein said sole engaging skids of said middle roof support units are linked at the end edges thereof facing said abutment beam to said sole plates.

3. A mine roof support as defined in claim 1, wherein each of said directing cylinder and piston units includes a cylinder and a piston rod having a free end, said cylinder being pivotally connected at an end thereof opposite to said free end of said piston rod to a respective one of said sole plates of said middle roof support unit and said free end of said piston rod being pivotally connected to the flat end member of the guide means adjacent thereto.

4. A mine roof support as defined in claim 1, wherein each of said guide means includes an elongated box-shaped housing fixedly connected to a portion of said flat end member facing away from said abutment beam, said advancing cylinder and piston unit being located in said box shaped housing and including a cylinder pivotally connected at the end thereof facing said abutment beam and a piston rod having a free end projecting beyong said cylinder and being pivotally connected by a pin extending transverse to the piston rod to the respective sole engaging skid, said box-shaped housing comprising two elongated side walls provided with slots extending in the direction of the elongated side wall and said pin extending through said slots.

5. A mine roof support as defined in claim 4, wherein said pair of sole engaging skids of each roof support unit are rigidly connected to each other by bridges of U-shaped cross-section.

6. A mine roof support as defined in claim 5, wherein said box-shaped housings of said guide means of said upper and lower roof support units are in part located beneath the respective bridges.

7. A mine roof support as defined in claim 1, wherein said abutment beam is divided into two beam sections linked together at adjacent ends, each of said beam sections being connected over a respective sole plate with the skids of the middle roof support unit.

8. A mine roof support as defined in claim 7, wherein each of said beam sections has a base portion and a pocket extending upwardly from said base portions and each of said flat end members has an upwardly offset end portion engaged in the respective pocket.

9. A mine roof support as defined in claim 8, wherein each of said beam sections has at the side thereof directed toward the face of the gallery to be mined a substantially vertical guide wall and stiffening ribs connected to said guide wall at the side thereof directed away from said mine face.

10. A mine roof support as defined in claim 1, wherein each of said roof support units comprises a roof shield above the skids and having a front end extending beyond said abutment beam, a rear shield linked to a rear end of said roof shield, expandable and contractable prop means between said skids and said roof shield for supporting the latter and linkage means between said rear shield and said skids.

* * * * *